US008444029B2

(12) United States Patent
Ferraro et al.

(10) Patent No.: US 8,444,029 B2
(45) Date of Patent: May 21, 2013

(54) REINFORCED HANGER AND ASSOCIATED PACKAGED PRODUCT ASSEMBLY

(75) Inventors: Brandon R. Ferraro, Minneapolis, MN (US); Keith C. Cedro, Clifton, NJ (US); Jake Strassburger, South Plainfield, NJ (US)

(73) Assignee: Target Brands, Inc., Minneapolis, MN (US)

( * ) Notice: Subject to any disclaimer, the term of this patent is extended or adjusted under 35 U.S.C. 154(b) by 82 days.

(21) Appl. No.: 13/042,703

(22) Filed: Mar. 8, 2011

(65) Prior Publication Data

US 2012/0228341 A1 Sep. 13, 2012

(51) Int. Cl.
*A41D 27/22* (2006.01)
*E05B 69/00* (2006.01)

(52) U.S. Cl.
USPC ..... 223/91

(58) Field of Classification Search
USPC ..... 223/85–98; D6/326, 327
See application file for complete search history.

(56) References Cited

U.S. PATENT DOCUMENTS

| | | | | |
|---|---|---|---|---|
| 1,099,261 | A * | 6/1914 | Lewyt | 223/97 |
| D118,984 | S | 2/1940 | Paterson | |
| 2,320,018 | A | 5/1943 | Ullman | |
| 2,340,320 | A | 2/1944 | Goldbert | |
| D140,337 | S | 2/1945 | Hill | |
| D140,338 | S | 2/1945 | Hill | |
| 2,412,735 | A | 12/1946 | Isaak | |
| 2,460,438 | A | 2/1949 | Treiman | |
| D153,032 | S | 3/1949 | Porter | |
| 2,643,037 | A | 6/1953 | Clover | |
| 2,912,150 | A | 11/1959 | Shapiro | |
| 3,087,605 | A | 4/1963 | Kester | |
| 3,172,531 | A | 3/1965 | Shillman | |
| 3,191,770 | A | 6/1965 | Zuckerman | |
| 3,257,049 | A * | 6/1966 | Smith | 223/88 |
| 3,435,999 | A | 4/1969 | Mantell | |
| D215,899 | S | 11/1969 | Soderberg | |
| 3,477,623 | A | 11/1969 | Milette et al. | |
| 3,557,944 | A | 1/1971 | Crane | |
| 3,680,746 | A | 8/1972 | Seckelmann | |
| 3,710,996 | A | 1/1973 | Smilow et al. | |
| 3,841,478 | A | 10/1974 | Wells et al. | |
| 3,862,687 | A | 1/1975 | Pirman | |
| 3,963,154 | A | 6/1976 | Schwartz et al. | |
| 4,177,908 | A | 12/1979 | Batts et al. | |
| 4,198,772 | A | 4/1980 | Furutu | |

(Continued)

OTHER PUBLICATIONS

U.S. Appl. No. 29/338,303, filed Jun. 9, 2009, entitled "Hanger."

*Primary Examiner* — Ismael Izaguirre
(74) *Attorney, Agent, or Firm* — Griffiths & Seaton PLLC

(57) ABSTRACT

A hanger includes a body and a hook. The body includes an upper crossbar, a lower crossbar spaced from and extending substantially parallel to the upper crossbar, and first and second sidebars extending between the upper crossbar and the lower crossbar opposite each other. The hook is coupled with and extends upwardly from a center of the upper cross bar. The upper cross bar includes a substantially linear intermediate section, an upper reinforcement section extending above the linear intermediate section, a lower reinforcement section extending below the substantially linear intermediate section, a first rib extending between and bordering each of the substantially linear intermediate section and the upper reinforcement section, and a second rib extending between and bordering each of the substantially linear intermediate section and the lower reinforcement section.

23 Claims, 10 Drawing Sheets

U.S. PATENT DOCUMENTS

D272,502 S 2/1984 Batts et al.
4,474,316 A 10/1984 Philibert
4,526,306 A 7/1985 Zuckerman et al.
4,556,158 A 12/1985 Blanchard et al.
4,557,516 A * 12/1985 Usner ..... 294/143
D289,829 S 5/1987 Klemetsrud
D296,046 S 6/1988 Marshall
D299,086 S 12/1988 Wilson
D301,661 S 6/1989 Wilson
D301,942 S 7/1989 Talbot-Titley
D301,943 S 7/1989 Wilson
D302,214 S 7/1989 Wilson
D303,324 S 9/1989 Wilson
D303,325 S 9/1989 Marshall
4,865,236 A 9/1989 Dongas
4,889,265 A 12/1989 Morgan
4,901,894 A 2/1990 Blanchard
4,951,855 A 8/1990 Jacobson et al.
5,092,502 A 3/1992 Kolton et al.
5,421,465 A 6/1995 Dunner, Jr.
D365,448 S 12/1995 Travis et al.
D371,246 S 7/1996 Gouldson et al.
5,556,014 A 9/1996 Kolton et al.
D375,208 S 11/1996 Gouldson
5,615,810 A 4/1997 Kolton et al.
5,649,653 A * 7/1997 Joseph ..... 223/85
5,758,806 A 6/1998 Anderson
5,806,728 A * 9/1998 Forsstrom et al. ..... 223/91
D400,718 S 11/1998 Bortolus
D401,705 S 11/1998 Jones
D405,343 S 2/1999 Oberdorf
5,868,289 A 2/1999 Lee
D408,156 S 4/1999 Eiley et al.
D410,793 S 6/1999 Gouldson
D415,620 S 10/1999 Prince et al.
6,085,950 A 7/2000 Gouldson et al.
6,142,347 A 11/2000 Kolton et al.
6,237,762 B1 5/2001 Faircloth
D445,265 S 7/2001 Yost
D446,947 S 8/2001 Paloheimo
6,286,734 B1 9/2001 Schneider
6,286,735 B1 9/2001 Zuckerman
6,508,357 B1 1/2003 Faircloth et al.
6,581,765 B1 6/2003 Rhyne
6,612,431 B2 9/2003 Faircloth
6,772,880 B2 8/2004 Beverly
D499,560 S 12/2004 Abdi et al.
D501,093 S 1/2005 Barre et al.
D504,577 S 5/2005 Mann
D513,595 S 1/2006 Weber et al.
6,981,588 B2 1/2006 Kimura
D527,536 S 9/2006 McCoy et al.
7,118,014 B2 10/2006 Ali et al.
7,152,768 B2 12/2006 Petrou
7,264,115 B1 9/2007 Uittenbogaard et al.
D560,373 S 1/2008 Gouldson
D563,681 S 3/2008 Barker
D567,516 S 4/2008 Mangano
D567,518 S 4/2008 Gouldson
7,513,366 B1 4/2009 Keating
D606,767 S 12/2009 Warren
7,753,241 B2 * 7/2010 Masanek, Jr. ..... 223/91
D633,310 S 3/2011 Song et al.
2002/0108975 A1 8/2002 Hunt et al.
2003/0209577 A1 11/2003 Gouldson et al.
2004/0050727 A1 3/2004 Fraistat et al.
2004/0262341 A1 12/2004 Petrou
2005/0194412 A1 9/2005 Petrou
2007/0045130 A1 3/2007 Kim
2007/0045136 A1 3/2007 Kim
2010/0307936 A1 12/2010 Anderson et al.

* cited by examiner

REINFORCED HANGER AND ASSOCIATED PACKAGED PRODUCT ASSEMBLY

BACKGROUND OF THE INVENTION

Retailers are continually evolving product displays in hopes of discovering more effective and visually attractive means for displaying products to potential consumers. In some instances, packaging for products is designed to facilitate product display. For example, given the limited shelf space available in retail stores, it is often desirable to provide product packaging configured to facilitate hanging of products from rods, pegs, or other display fixture support members.

SUMMARY OF THE INVENTION

One aspect of the present invention relates to a hanger including a body and a hook. The body includes an upper crossbar, a lower crossbar spaced from and extending substantially parallel to the upper crossbar, and first and second sidebars extending between the upper crossbar and the lower crossbar opposite each other. The hook is coupled with and extends upwardly from a center of the upper cross bar. The upper cross bar includes a substantially linear intermediate section, an upper reinforcement section extending above the substantially linear intermediate section, a lower reinforcement section extending below the substantially linear intermediate section, a first rib extending between and bordering each of the substantially linear intermediate section and the upper reinforcement section, and a second rib extending between and bordering each of the substantially linear intermediate section and the lower reinforcement section. In one embodiment, each of the first rib and the second rib have a thickness greater than each of the substantially linear intermediate section, the lower reinforcement section, and the upper reinforcement section, and/or each of the upper reinforcement section and the lower reinforcement section define a substantially planar rear surface and an opposite substantially planar front surface. Other related products, assemblies and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

Embodiments of the present invention provide a hanger configured to support textiles, for example, thick and/or heavy textiles, or similar items in a retail or similar environment. The hanger is reinforced in a manner providing sufficient strength to handle heavy textile products, such as quilts, rugs, etc., and/or their packaging while still limiting the overall material needed to form the hanger in both an economically and environmentally friendly manner. Using a hanger to support textile products typically considered to be too heavy for hanging in a retail environment allows retail space to be utilized in a different manner requiring little or no shelf space while still presenting the textile product in an easily viewed and structurally sound manner.

Figure 12:
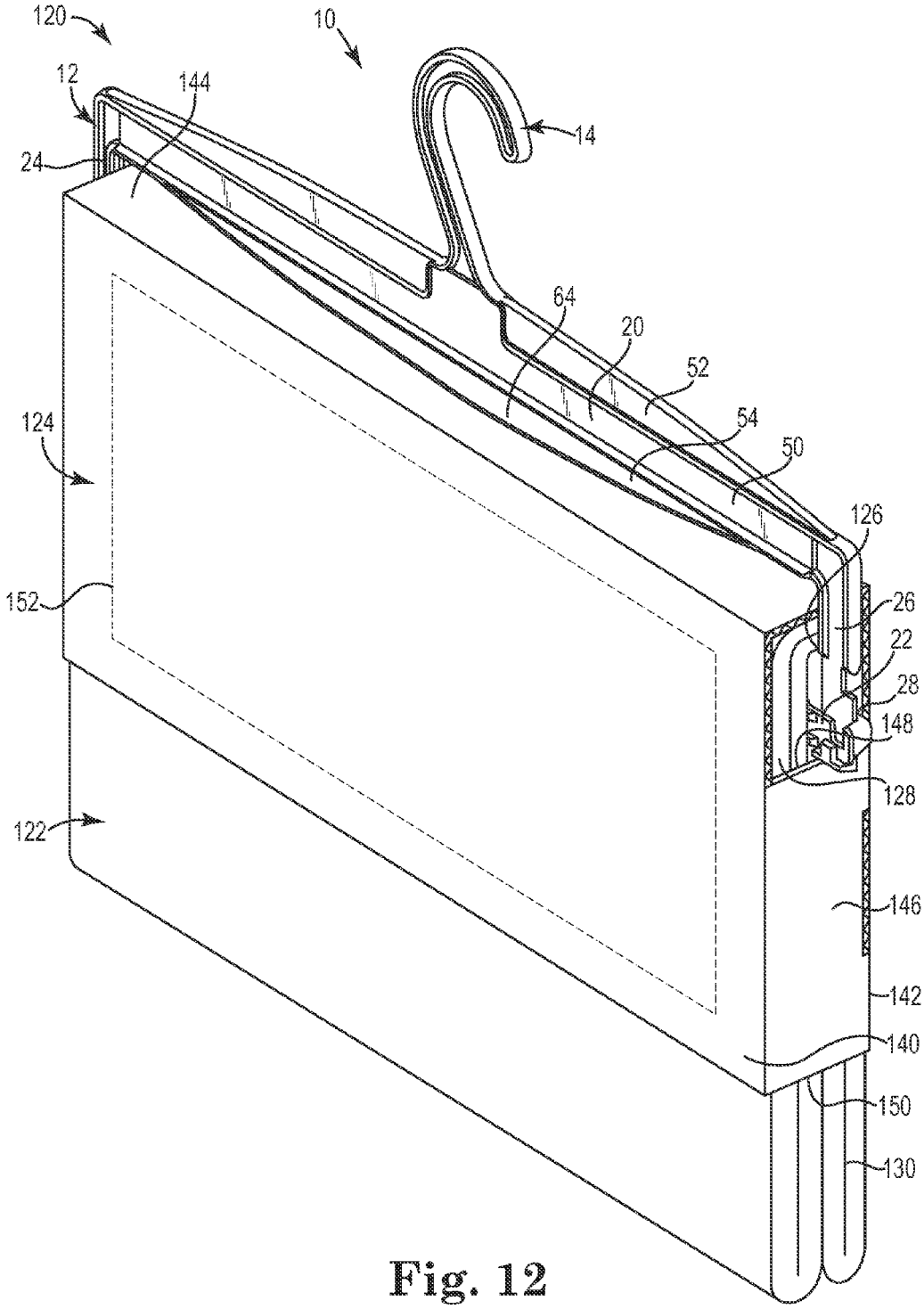
FIG. 12 is a front, perspective view illustration of a packaged product including the hanger of FIG. 1, according to one embodiment of the present invention.

Turning to the figures, FIGS. 1-8 illustrate a hanger 10, according to one embodiment of the invention, including a body 12 and a hook 14. Body 12 is configured to provide a horizontal support structure for receiving a textile product 122 (FIG. 12) or other article for retail sale as well as structural stability to the overall, resultant packaged product assembly 120 (FIG. 12). Hook 14 extends upwardly from body 12 and is configured to interface with a rod, hanging bar, or other suitable support such that hanger 10 and packaged product assembly 120 hang therefrom.

In one embodiment, body 12 includes various segments, for example, an upper crossbar 20, a lower crossbar 22, a first sidebar 24, and a second sidebar 26. As illustrated in FIGS. 1-8, when hanger 10 is closed, upper crossbar 20 and lower crossbar 22 extend to be substantially parallel to and spaced from one another. First sidebar 24 extends from upper crossbar 20 to lower crossbar 22, and second sidebar 26 is positioned opposite first sidebar 24 and also extends from upper crossbar 20 downwardly toward lower crossbar 22.

In one example, upper crossbar 20, lower crossbar 22, first sidebar 24, and second sidebar 26 are each substantially linear and collectively define body 12 as a substantially rectangular frame structure. In particular, first sidebar 24 extends upwardly from an end of lower crossbar 22 toward upper crossbar 20. Upper crossbar 20 extends from first sidebar 24 opposite lower crossbar 22 in a direction substantially perpendicular to first sidebar 24. Second sidebar 26 extends downwardly from upper crossbar 20 opposite and substantially parallel to first sidebar 24. Lower crossbar 22 extends from second sidebar 26 opposite and substantially parallel to upper crossbar 20 toward first sidebar 24.

As pictured in FIGS. 1-8, in one example, a void or opening 27 is defined between upper crossbar 20, lower crossbar 22, first sidebar 24, and second sidebar 26. As described herein, corners of body 12 form the transition between upper crossbar 20 and each of first sidebar 24 and second sidebar 26 as well as the transition between lower crossbar 22 and each of first sidebar 24 and second sidebar 26. In one embodiment, at the intersection of lower crossbar 22 and second sidebar 26, hanger 10 defines a latch 28 allowing for selective coupling of lower crossbar 22 and second sidebar 26 as will be described in further detail below.

In one example, hanger 10 generally includes planar primary portion 30 that forms the basic substantially planar structure of hanger 10 that is added to or subtracted from to form the various other portions of hanger 10 having differing thicknesses (e.g., an increased thickness) than planar primary portion 30. Planar primary portion 30 defines a front surface 32 and a rear surface 34 opposite front surface 32. In one embodiment, an inner perimeter rib 36 or elongated protrusion extends from at least one of and, in one example, both of front surface 32 and rear surface 34 of planar primary portion 30 outwardly away from the other of front surface 32 and rear surface 34. In one example, inner perimeter rib 36 extends along at least a portion of each of lower crossbar 22, first sidebar 24, and second sidebar 26 immediately adjacent or near to opening 27.

In one embodiment, hanger 10 includes an outer perimeter rib 38 or elongated protrusion extending, for example, around an outside perimeter (e.g., opposite inner perimeter rib 36) of at least a portion of each of lower crossbar 22, first sidebar 24, and second sidebar 26. Outer perimeter rib 38 extends from at least one of and, in one example, both of front surface 32 and rear surface 34 of planar primary portion 30 outwardly away from the other of front surface 32 and rear surface 34. Inner perimeter rib 36 and outer perimeter rib 38 add to the overall rigidity of hanger 10, in particular, at least a portion of each of lower crossbar 22, first sidebar 24, and second sidebar 26 without requiring an increase in thickness in the amount of material used to form the entire width of each of lower crossbar 22, first sidebar 24, and second sidebar 26. Each of inner perimeter rib 36 and outer perimeter rib 38 extending along each of the associated members (i.e., lower crossbar 22, first sidebar 24, and second sidebar 26) provides additional resistance to twisting, torque, and other forces without requiring an entirety of lower crossbar 22, first sidebar 24, and second sidebar 26 to be formed with a greater material thickness.

In one embodiment, upper crossbar 20 is reinforced and includes a plurality of reinforcing or strengthening sections or portions adding to the overall width of upper crossbar 20 to provide additional strength and rigidity to upper crossbar 20. Additionally referring to FIG. 9, in one example, upper crossbar 20 has an overall height $H_{CB}$ and an overall length $L_{CB}$. For example, upper crossbar 20 includes an intermediate section 50, an upper reinforcement section 52, and a lower reinforcement section 54. Intermediate section 50 extends generally from and between each of first sidebar 24 and second sidebar 26. With a height $H_I$, which, in one embodiment, is consistent along a substantial entirety of length $L_{UCB}$ of upper crossbar 20. In one embodiment, intermediate section 50 maintains a consistent thickness with planar primary portion 30 of hanger 10. In another embodiment, immediate section 50 is formed with at least a thickened portion 56 having greater thickness than planar primary portion 30, for example, thickened in both a frontwardly and rearwardly direction from front surface 32 and rear surface 34, respectively, of planar primary portion 30. As such, in one embodiment, a stepped transition 58 is formed between planar primary portion 30 and the thickened portion 56 of upper crossbar 20 on both the front and rear of planar primary portion 30. In one embodiment, thickened portion 56 extends along substantially all of a length of upper crossbar 20.

Upper reinforcement section 52 extends upwardly from (i.e., toward hook 14) intermediate section 50 with a length $L_{UR}$ extending along slightly less than and/or substantially equal to length $L_{UCB}$ of upper crossbar 52. In one embodiment, length $L_{UR}$ of upper reinforcement section 52 is centered relative to and extends along at least about 60% of overall length $L_{UCB}$ of upper crossbar 52, for example, along at least about 80% of overall length $L_{UCB}$ of upper crossbar 52 where intermediate section 50 has a length substantially equal to overall length $L_{CB}$ of upper crossbar 20. While upper reinforcement section 52 may be formed in any one of a variety of shapes, etc. as will be apparent to those of skill in the art upon reading the present application, in one embodiment, upper reinforcement section 52 is symmetrically formed about a centerline of hanger 10 (which, in one embodiment, is the same as a centerline of intermediate section 50) as a flattened, curvilinear shape. For example, upper reinforcement section 52 tapers or otherwise transitions toward intermediate section 50 from a maximum value of height $H_{UR}$ of upper reinforcement section 52 near centerline of hanger 10 to a minimum value of height $H_{UR}$ on either side of the centerline as upper reinforcement section 52 extends away from the centerline of hanger 10. As such, upper reinforcement section 52 has its greatest height $H_{UR}$ in the middle of upper reinforcement section 52 just below hook 14. In one embodiment, upper reinforcement section 52 defines a substantially planar front surface and an opposing substantially planar rear surface with a thickness of upper reinforcement section 52 as defined between the substantially planar front surface and the opposing substantially planar rear surface. In one example, the thickness is greater than a thickness of planar primary panel 40, for instance, a thickness substantially equal to the thickness of thickened portion 56 of intermediate section 50.

In one embodiment, a first or upper boundary rib 60 or elongated protrusion extends between and along a boundary of upper reinforcement section 52 and intermediate section 50. Upper boundary rib 60 extends in front of front surface 30 and in back of rear surface 32. In one example, upper boundary rib 60 has a thickness greater than each of upper reinforcement section 52 and intermediate section 50 including thickened portion 56. In one example, the thickness of upper boundary rib 60 is identical or at least substantially the same as a thickness of outer perimeter rib 38 and extends from ends of outer perimeter rib 38 such that upper boundary rib 60 and outer perimeter rib 38 collectively define a continuous rib around body 12 without a stepped or other thickness transition. In one embodiment, upper boundary rib 60 is substantially linear and extends parallel to a portion of outer perimeter rib 38 extending along lower crossbar 22 and/or includes a non-linear extension 66 near a transition from body 12 up to hook 14. In one example, non-linear extension 66 is shaped similar to a body to hook transition of a conventional, non-reinforced hanger, which creates an aesthetically conforming or at least an aesthetically corresponding look when used with associated ones of the conventional, non-reinforced hangers in the same space, for example, within the same retail store or area thereof. In one example, upper reinforcement section 52 is characterized by an upper, exposed edge free from any reinforcement ribs, etc. having a thickness greater than upper reinforcement section 52.

Lower reinforcement section 54 extends downwardly (i.e., toward lower crossbar 22) from intermediate section 50 along a length $L_{LR}$, which is substantially equal to, for instance, at least about 60% of, and, in one embodiment, at least about 80% of, a length of intermediate section 50 and/or overall length $L_{CB}$ of upper crossbar 20 as a whole. In one embodiment, lower reinforcement section 54 extends downwardly from intermediate section 50 with increasing distance toward a center of hanger 10. As such, in one example, lower reinforcement section 50 has a curved lower boundary such that a height of lower reinforcement section 50 gradually increases toward its maximum value, a height $H_{LR}$, at the center of hanger 10 (see, e.g., FIG. 9). In other words, lower reinforcement section 54 tapers or otherwise transitions toward intermediate section 50 from a maximum value of height $H_{LR}$ of lower reinforcement section 54 near centerline of hanger 10 to a minimum value of height $H_{LR}$ on either side of the centerline as lower reinforcement section 54 extends away from the centerline of hanger 10.

In one example, the curvature of lower reinforcement section 50 is symmetrical about the centerline of hanger 10. In one embodiment, lower reinforcement section 54 has a thickness substantially equal to a thickness of thickened portion 56 of intermediate section 50, which, is thicker than planar primary portion 30 such that front and rear surface of lower reinforcement section 54 extend in front of and behind front surface 32 and rear surface 34 of planar primary portion 30, respectively. In one embodiment, lower reinforcement section 50 defines a substantially planar front surface and an opposing substantially planar rear surface.

Figure 1:
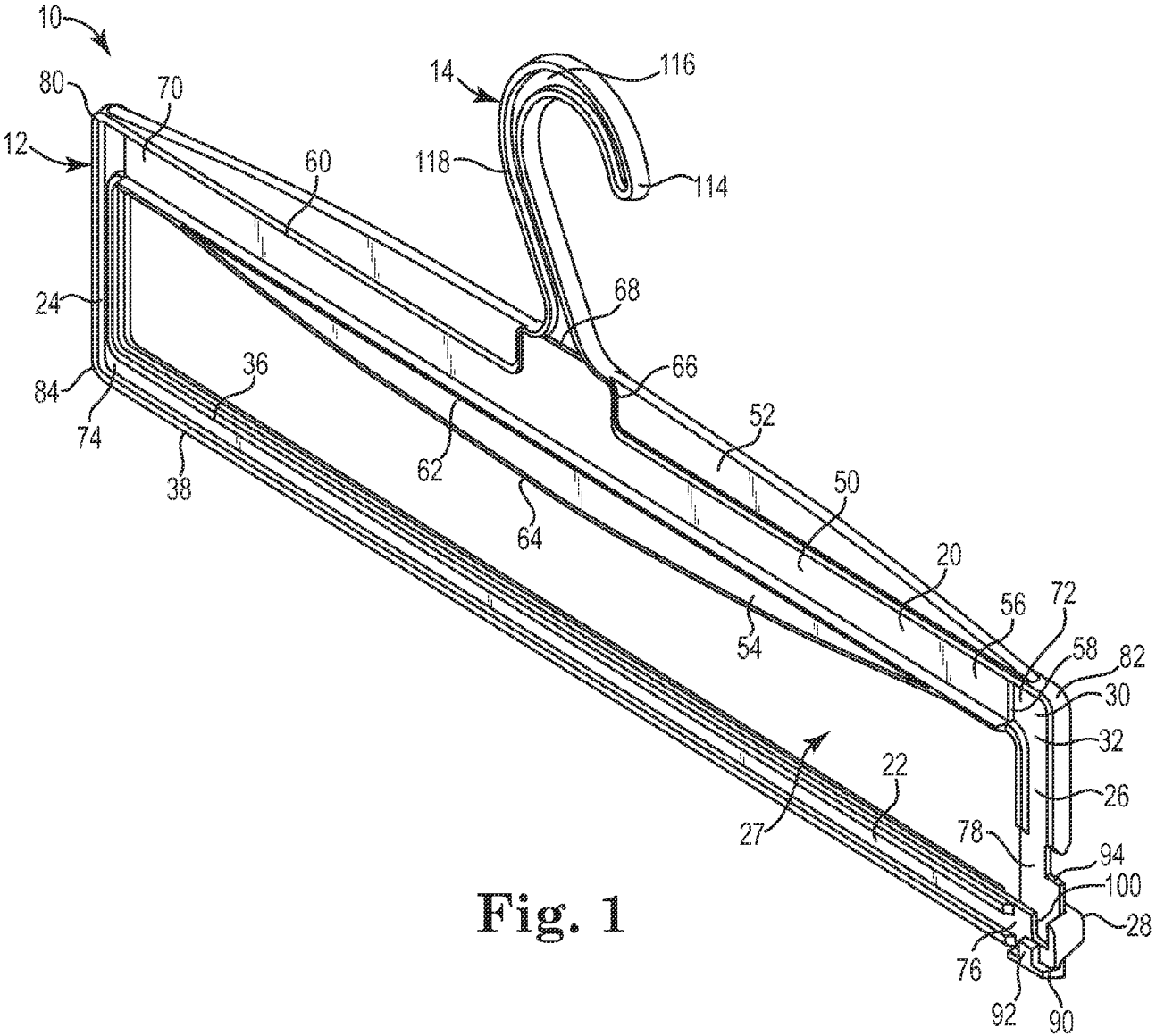
FIG. 1 is a top, front perspective view illustration of a hanger in the closed position, according to one embodiment of the present invention.
Figure 2:
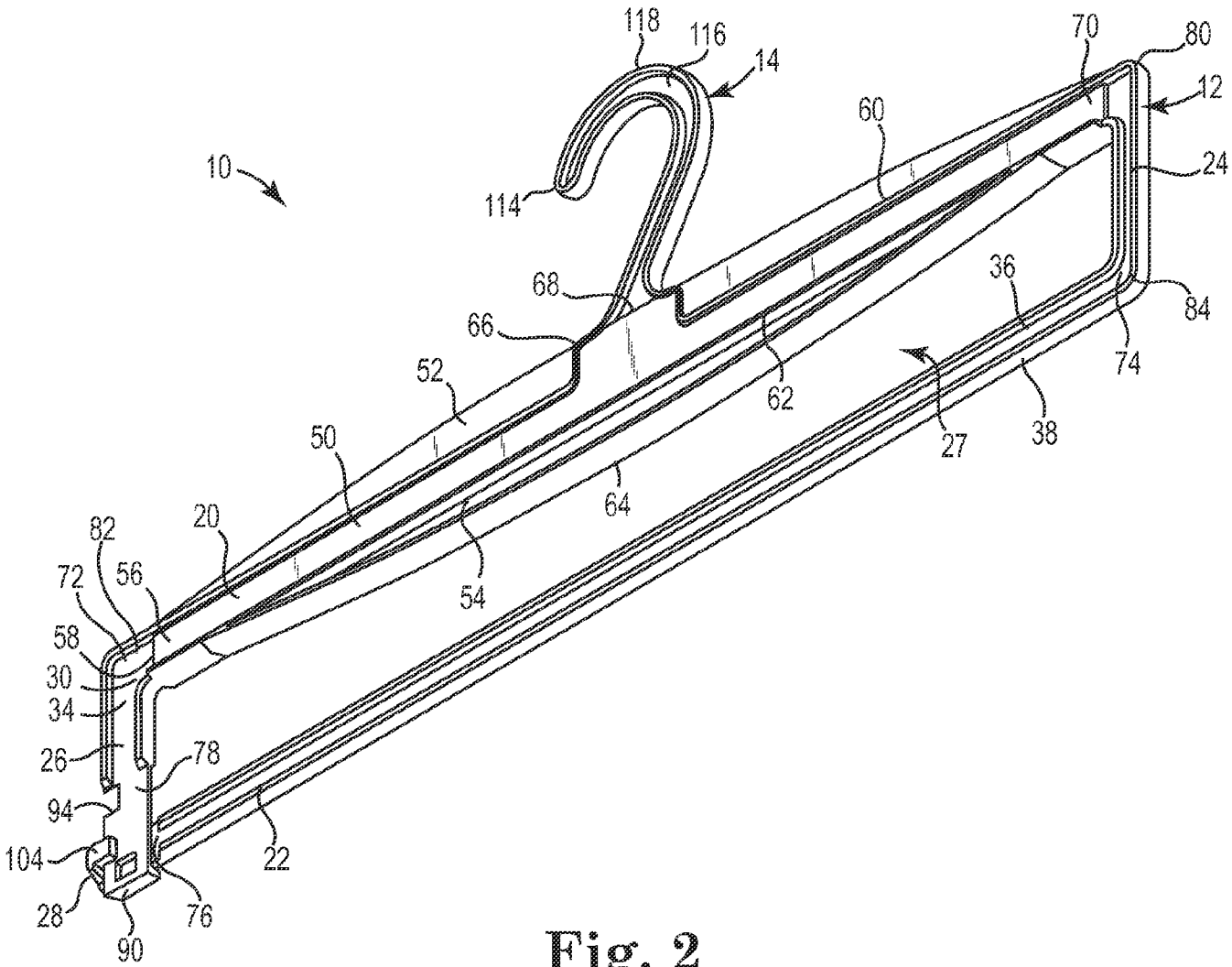
FIG. 2 is a bottom, rear perspective view illustration of the hanger of FIG. 1 in the closed position, according to one embodiment of the present invention.
Figure 3:
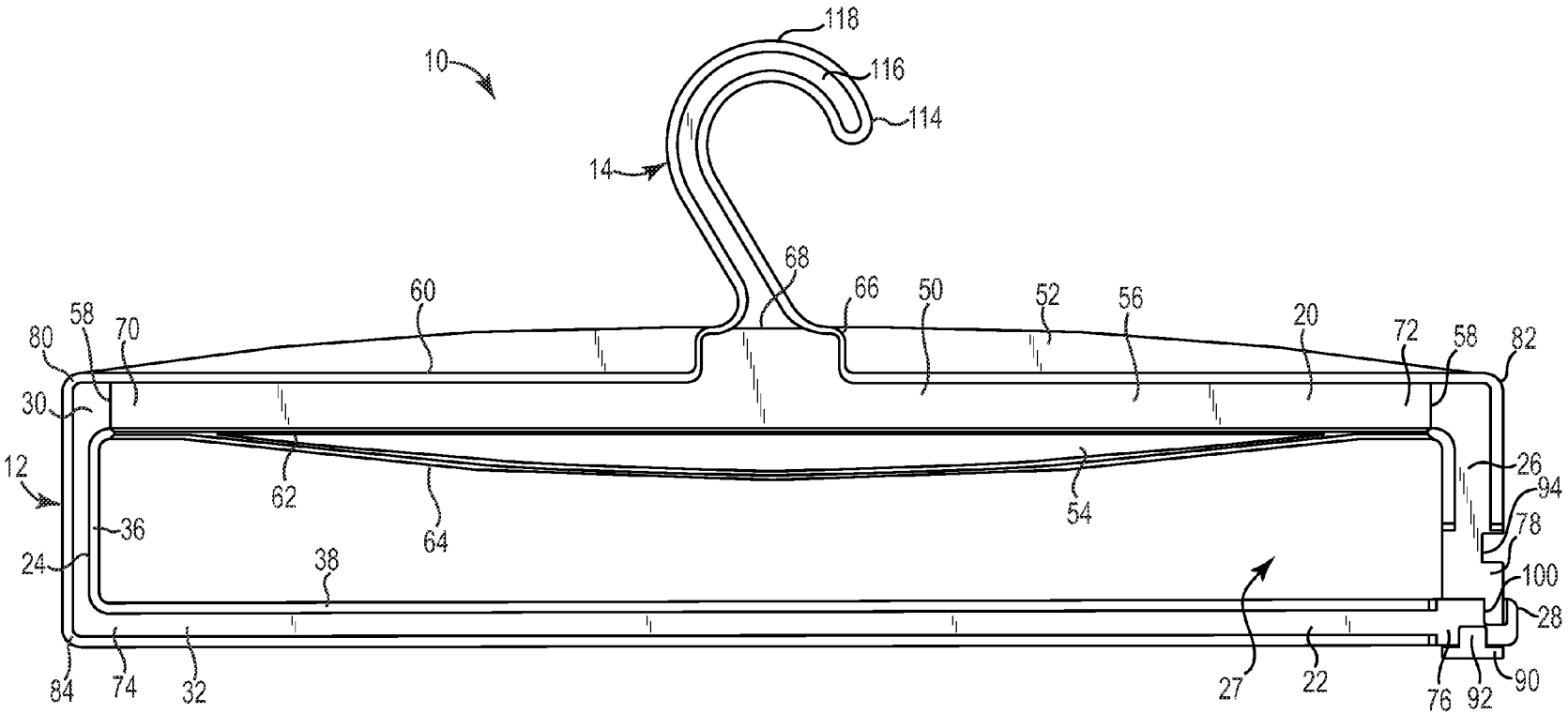
FIG. 3 is a front view illustration of the hanger of FIG. 1 in the closed position, according to one embodiment of the present invention.
Figure 4:
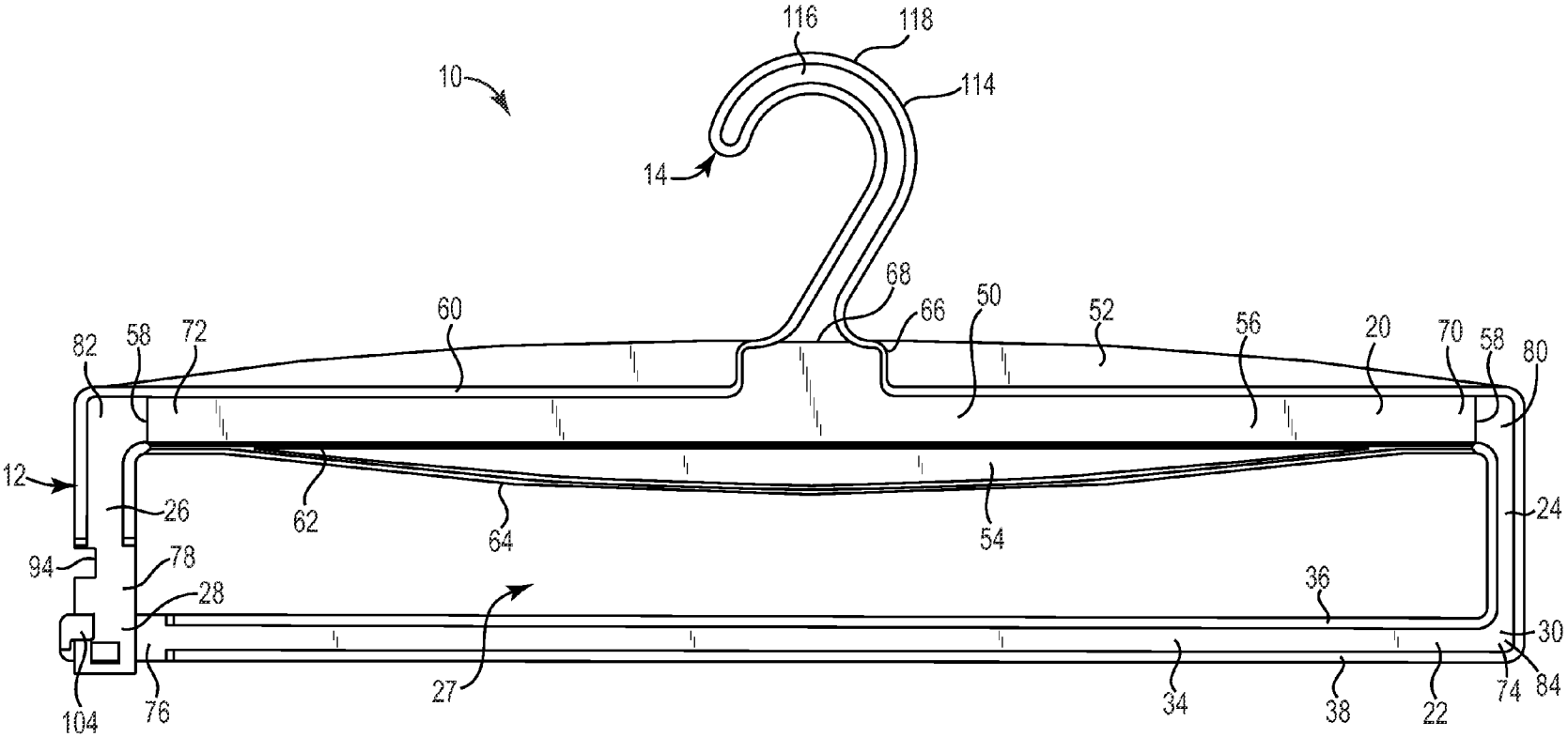
FIG. 4 is a rear view illustration of the hanger of FIG. 1 in the closed position, according to one embodiment of the present invention.
Figure 5:
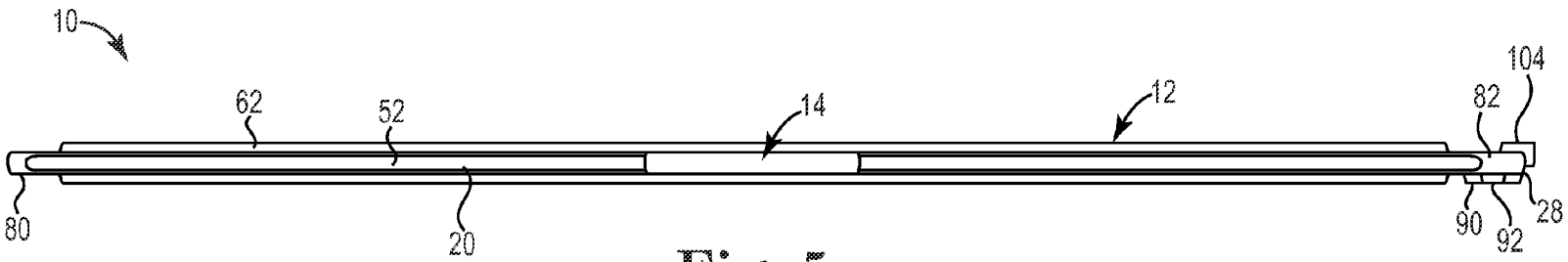
FIG. 5 is a top view illustration of the hanger of FIG. 1 in the closed position, according to one embodiment of the present invention.
Figure 6:
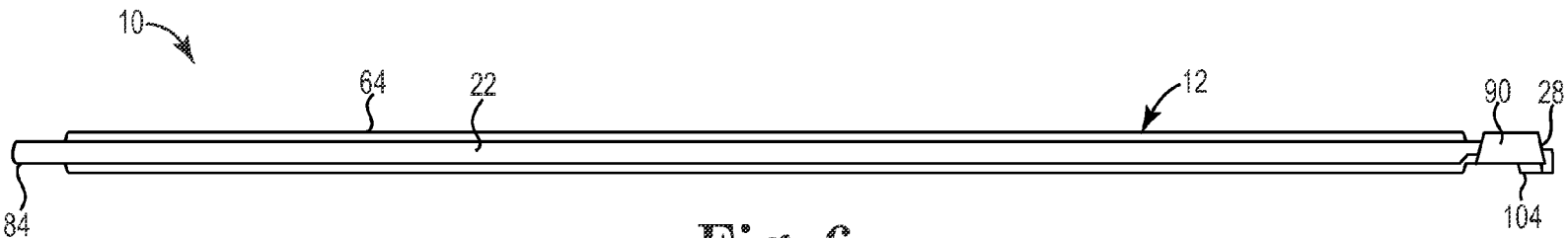
FIG. 6 is a bottom view illustration of the hanger of FIG. 1 in the closed position, according to one embodiment of the present invention.
Figure 8:
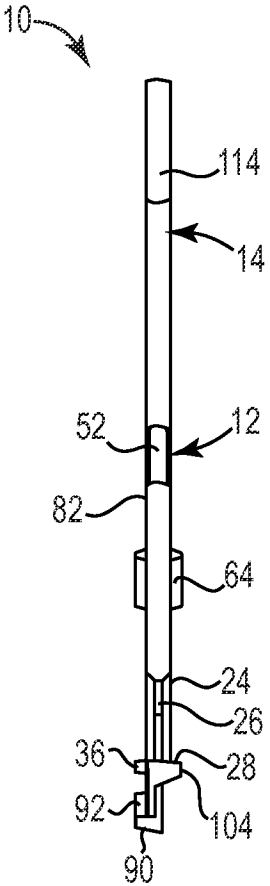
FIG. 8 is a right side view illustration of the hanger of FIG. 1 in the closed position, according to one embodiment of the present invention.
Figure 7:
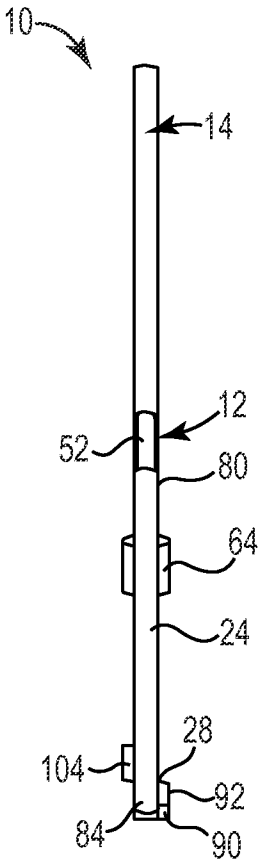
FIG. 7 is a left side view illustration of the hanger of FIG. 1 in the closed position, according to one embodiment of the present invention.
Figure 9:
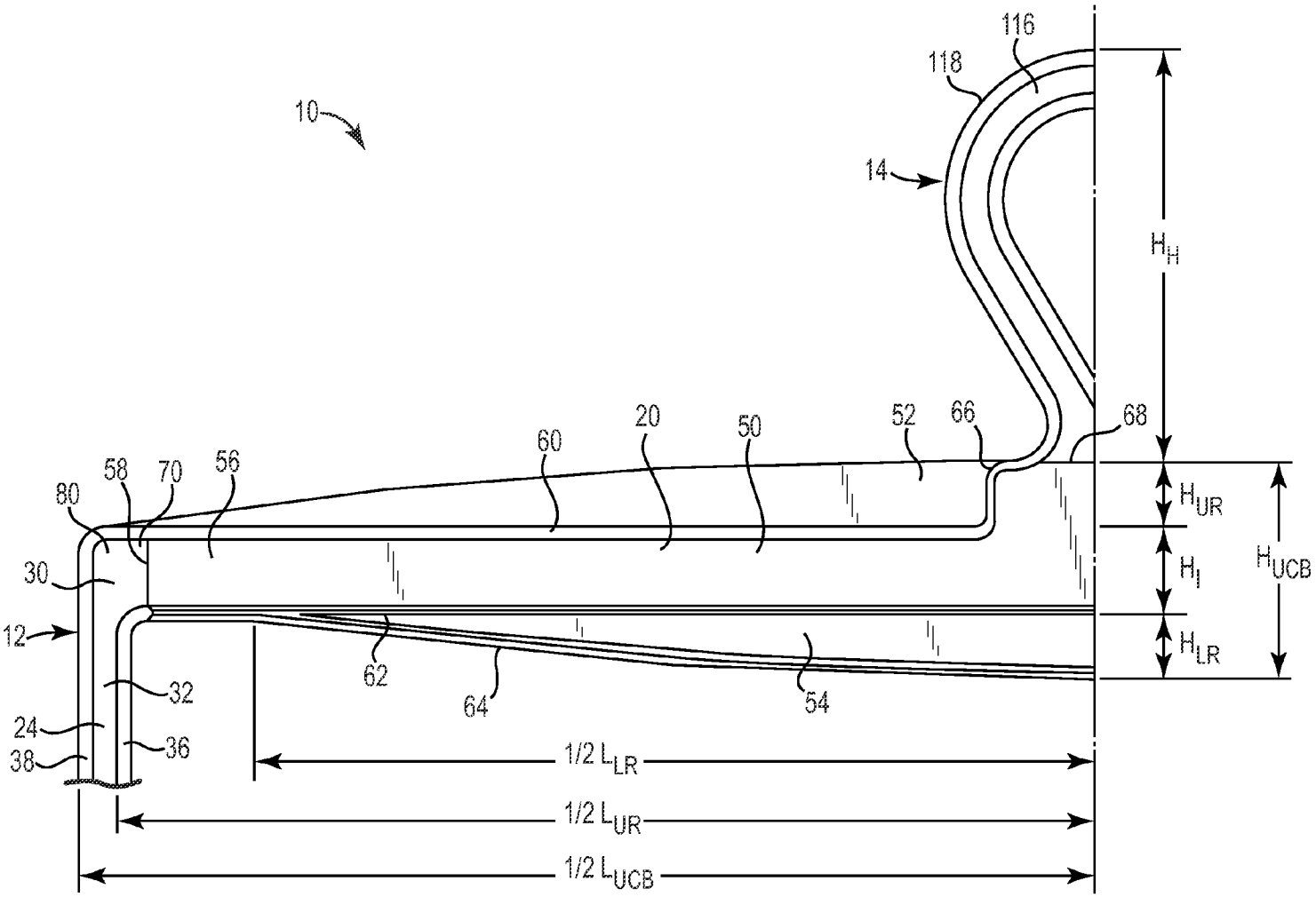
FIG. 9 is an illustration of an enlarged portion of the hanger of FIG. 2, according to one embodiment of the present invention.

In one embodiment, hanger 10 includes a second or lower boundary rib 62 or elongated protrusion extending between and along a boundary between intermediate section 50 and lower reinforcement section 54. Lower boundary rib 62 has a thickness greater than each of thickened portion 56 of intermediate section 50 and lower reinforcement section 54. In one example, the thickness of lower boundary rib 62 is greater than the thickness of either upper boundary rib 60 or outer perimeter rib 38. In one example, lower boundary rib 62 extends about twice a distance in front of and in back of the respective front and back surfaces of planar primary portion 30 as compared to upper boundary rib 60. In one embodiment, lower boundary rib 62 is substantially linear and extends parallel to a portion of outer perimeter rib 38 extending along lower crossbar 22 and/or to upper boundary rib 60. In one example, lower boundary rib 62 begins and terminates in the side-to-side direction (e.g., the left-to-right direction as illustrated in FIGS. 3, 4, and 9) at similar positions as thickened portion 56 of intermediate section 50 such that lower boundary rib 62 has a length equal to a length of thickened portion 56 of intermediate section 50. In one embodiment, lower boundary rib 62 has a length greater than length $L_{LR}$ of lower reinforcement section 54.

In one embodiment, hanger 10 further includes a lower edge rib 64 or elongated protrusion extending along the lowermost edge of lower reinforcement section 54, that is, the edge opposite lower boundary rib 62. In one example, lower edge rib 64 is the lowest portion of upper crossbar 20. In one embodiment, lower edge rib 64 has a thickness greater than lower reinforcement section 54, for example, equal to the thickness of lower boundary rib 62, which, in one example, forms the thickest portions of upper crossbar 20 and/or of hanger 10 as a whole. In one example, lower edge rib 64 continuously extends along a bottom edge of lower reinforcement section 54 and intersects lower boundary rib 62 terminated at each opposing end of lower reinforcement section 54. Lower boundary rib 62 continues beyond the terminating ends of lower edge rib 64 and extends to the lower edge of a corner intersection between upper crossbar 20 and a respective one of first sidebar 24 and second sidebar 26. In one embodiment, upper crossbar 20 is solid characterized by an absence of voids between a top edge of upper reinforcement section 52 and lower edge rib 64.

Upper crossbar 20 includes first end 70 and second end 72 on opposing sides, considered right to left, of intermediate section 50. First end 70 and second end 72 are both formed as part of planar primary portion 30 and, in one embodiment, are formed at the base thickness of planar primary portion 30 without additional reinforcement other than where inner perimeter rib 36, outer perimeter rib 38, first boundary rib 60, and lower boundary rib 62 extend on either the outer or inner perimeter thereof.

In one embodiment, upper crossbar 20 is formed in a symmetrical manner from front to back and from left to right of hanger 10. Upper crossbar 20, for example, as described in the embodiments above, is provided with various degrees of relief or topography. For example, upper crossbar 20 includes first end 70 and second end 72, which are the thinnest portions of upper crossbar 20, in relation to intermediate section 50, upper reinforcement section 52, and lower reinforcement section 54 which have a greater thickness than planar primary portion 30. In one embodiment, first boundary rib 60 has a greater thickness than intermediate section 50, upper reinforcement section 52, and lower reinforcement section 54. In one example, lower boundary rib 62 and lower edge rib 64 form the thickest portions of upper crossbar 20 and, therefore, are thicker than upper boundary rib 60. The various relief portions included in upper crossbar 20 allow upper crossbar 20 to be formed with a rigidity to decrease or prevent undesired sagging and/or twisting thereof during use without requiring the entire upper crossbar 20 to be formed at the greatest thickness. As a result, hanger 10 has increased strength and rigidity to support relatively heavy textile products 122 or other articles while reducing amount of material needed to form hanger 10.

Body 12 of hanger 10 is arranged such that first sidebar 24 extends downwardly from first end 70 of upper crossbar 20 and second sidebar 26 extends downwardly from second end 72 of upper crossbar 20. The intersection between upper crossbar 20 with each of first sidebar 24 and second sidebar 26 defines a first top corner 80 and a second top corner 82, respectively. Lower crossbar 22 defines a first end 74 and an opposite second end 76. First end 74 intersects with first sidebar 24 opposite first end 70 of upper crossbar 20 to form a first lower corner 84. In one embodiment, second end 76 of lower crossbar 22 is a free end not rigidly joined with another portion of hanger 10. In one embodiment, since second end 76 of lower crossbar 22 is a free end, second sidebar 26 forms a free and lower end 78 opposite second top corner 82 of hanger 10. Second end 76 of lower crossbar 22 and lower end 78 of second sidebar 26 are configured to selectively interact with one another to open and close hanger 10.

Figure 10:
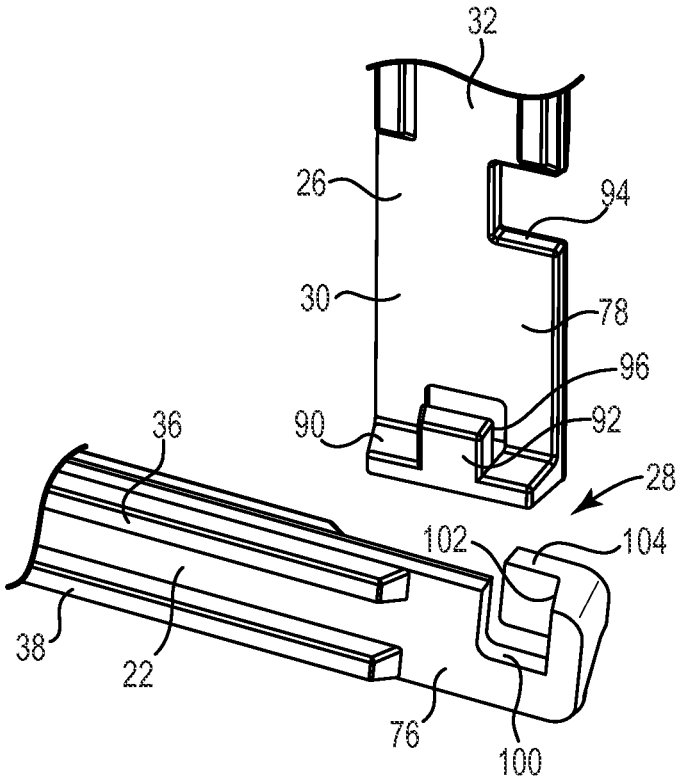
FIG. 10 is an enlarged, detailed view illustration of a latch of the hanger of FIG. 1 with the hanger in an open position, according to one embodiment of the present invention.
Figure 11:
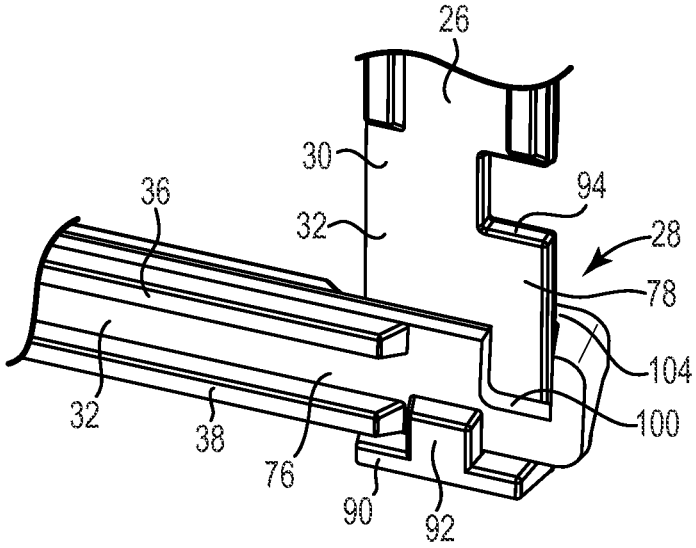
FIG. 11 is an enlarged, detailed view illustration of the latch of the hanger of FIG. 1 with the hanger in the closed position, according to one embodiment of the present invention.

More specifically, in one embodiment, latch 28 is collectively formed by second end 76 of lower crossbar 22 and lower end 78 of second sidebar 26 as illustrated with additional reference to FIGS. 10 and 11. In one example, lower end 78 of second sidebar 26 defines a first portion of latch 28 and includes a lower ledge or flange 90 and a protrusion 92. Flange 90 extends forwardly from a portion of front surface 32 defined by second sidebar 26. Protrusion 92 extends upwardly from flange 90 opposite a portion of front surface 32 defined by second sidebar 26 to form a space 96 between the portion of front surface 32 defined by second sidebar 26 and protrusion 92. In one embodiment, space 96 has a thickness substantially equal to or slightly larger than a thickness of planar primary portion 30, for example, an area of planar primary portion 30 defining second end 76 of lower crossbar 22. In one embodiment, second sidebar 26 defines a notch 94 extending inwardly from an outer edge of second sidebar 26 and upwardly spaced from flange 90 and protrusion 92.

In one example, second end 76 of lower crossbar 22 defines a second portion of latch 28 and includes an opening or notch 100, an offset section or offset tab 102, and a return section or return tab 104. Notch 100 is formed in second end 76 near the endmost portion thereof and extends from a top edge downwardly into lower crossbar 22. Offset tab 102 extends rearwardly from a portion of rear surface 34 defined by lower crossbar 22 adjacent to notch 100 opposite first end 74 of lower crossbar 22, and return tab 104 extends from offset tab 102 opposite rear surface 34 and extends toward first end 74 of lower crossbar 22. In one embodiment, return tab 104 is sized and shaped similar to notch 100.

The two portions of latch 28 are configured to interact with one another to selectively hold hanger 10 in a closed position, that is, with second end 76 of lower crossbar 22 coupled with lower end 78 of second sidebar 26. More specifically, in one embodiment, to close latch 28, second end 72 of lower crossbar 22 is raised (e.g., effectively rotated about first end 70 of lower crossbar 22) from the open hanger position shown, for example, in FIG. 10, to vertically align return tab 104 of lower crossbar 22 with notch 94 formed in second sidebar 26. Once so aligned, second end 72 is pushed rearwardly toward notch 94 moving return tab 104 through notch 94 and to a rear side of second sidebar 26. Subsequently, second end 72 of lower crossbar 22 is moved downwardly to set second end 72 of lower crossbar 22 to snugly fit at least partially within space 96 defined between flange 90 and protrusion 92 of second sidebar 26 to hold hanger 10 in a closed position as shown, for example, in FIG. 11. In one embodiment, when latch 28 and hanger 10 are closed, lower end 78 of second sidebar 26 extends between return tab 104 and a portion of rear surface 32 defined by lower crossbar 22. In one example, when hanger 10 is closed, protrusion 92 and return tab 104 extend substantially parallel to one another and perpendicular to each of flange 90 and offset tab 102. Notably, one of skill in the art will recognize, upon reading this application, that while flange 90 is described as extending forwardly from front surface 32 and offset tab 102 is described as extending rearwardly from rear surface 34, the configuration can be switched such that flange 90 would extend rearwardly from rear surface 34 and offset tab 102 would extend forwardly from front surface 32.

Hook 14 extends upwardly from and is substantially longitudinally centered left to right with respect to upper crossbar 20 of body 12. Hook 14 includes a free end 114, a primary section 116, and a surrounding hook rib 118. Primary section 116 extends initially upwardly from a center of upper crossbar 20 just above stepped transition 68 and then transitions into a downward curve to form a hooked shape with free end 114 opposite upper crossbar 20. As such, near free end 114, hooked portion 14 is substantially curvilinear and open to receive and hang from a supporting structure such as a support rod or other suitable structure (not shown).

In one embodiment, primary section 116 has a thickness less than the thickness of intermediate section 50 or upper reinforcement section 52 such that a stepped transition 68 is formed between body 12 and hook 14. In one embodiment, primary section 116 has a thickness substantially equal to the thickness of planar primary portion 30.

In one example, hook rib 118 extends around all edges of hook 14 other than an edge that directly interfaces with upper crossbar 20 beyond front and back surfaces of primary section 116, that is, with a greater thickness than primary section 116, to provide additional rigidity to hook 14 without increasing the thickness of the entire hook 14 to save on material and monies needed to manufacture hanger 10. In one embodiment, hook rib 118 has a thickness substantially similar to the thickness of upper boundary rib 60 such that the thickness continually remains consistent between hook rib 118, and upper boundary rib 60 which intersection each other end to end.

In one embodiment, hanger 10 is formed as a single, injection molded piece of material, such as polystyrene, polypropylene or other suitable plastic or injection moldable material, having the desired elastomeric properties to allow manipulation of lower crossbar 22 relative to first sidebar 24 as will be further described below. In one example, hanger 10 is formed of a plastic that is readily recyclable. Other materials for and methods of forming hanger 10 will be apparent to those of skill in the art upon reading the present application.

Hanger 10, as described above, includes reinforced upper crossbar 20 designed to at least decrease sagging and twisting of upper crossbar 20 and hanger 10 as a whole when relatively heavy items are hung from lower crossbar 20. Such a reinforced hanger 10 is particularly advantageous in the area of fabric-based home goods (e.g., curtains, tablecloths, napkins, and other linens) and/or suitable fabric-based clothing goods (e.g., scarves, socks, stockings, etc.). During retail display, for example, such fabric-based home goods are conventionally placed on store shelves or wrapped substantially or entirely in non-recyclable polyvinyl bags with apertures for receiving support pegs or similar support.

Referring to FIG. 12, in one example, hanger 10 and a box 124 are used to package textile product 122 or other suitable item to form packaged product assembly 120 that can be hung from a retail support rod or similar support. By replacing polyvinyl bags with a composite assembly including readily recyclable corrugated cardboard (e.g., box 124) and a more environmentally friendly plastic hanger (e.g., hanger 10), associated manufacturers and/or retailers are making environmentally responsible contributions to the long-term well being of the planet while still providing an aesthetically pleasing, economically feasible retail display.

In one example, packaged product assembly 120 includes textile product 122 or other article for retail sale, hanger 10, and a sheath or box 124. In one embodiment, textile product 122 is formed of a woven or non-woven fabric configured to be folded or similarly manipulated into a substantially smaller shape than when entirely unfolded. In one embodiment, textile product 122 includes at least one of a fabric-based home good item of a relatively heavy nature (e.g., a quilt, comforter, table cloth, or drapery panel) a suitable fabric-based clothing item (e.g., a scarf, stocking, or sock item), or other similar item offered for retail sale. Hanger 10 is configured to hang from a retail display while holding textile product 122 and box 124. In one embodiment, box 124 wraps around at least a portion of the corresponding textile product 122 and lower crossbar 22 of hanger 10 to enclose the portion of textile product 122 and lower crossbar 22. Box 124 protects textile product 122, more securely holds textile product 122 relative to hanger 10, and provides surface area for display of promotional and/or informational indicia relating to textile product 122.

More specifically, in one embodiment, textile product 122 is sized or folded to a size to hang neatly over lower crossbar 22 of hanger 10, that is, to have a width less than a distance between inside edges of first sidebar 24 and second sidebar 26 (e.g., a width of opening 27). In addition, textile product 122 is folded over lower crossbar 22 such that textile product 122 defines a fold line 126 placed directly over lower crossbar 22 with a first portion 128 of textile product 122 being defined on one side of fold line 126 and a second portion 130 being defined on the opposing side of fold line 126.

Box 124 is sized and shaped for use with hanger 10 to wrap at least a portion of textile product 122 for retail sale. In one embodiment, box 124 is folded from a single planar sheet of appropriate material, such as paperboard, chipboard, corrugated cardboard, etc., for example, as described in U.S. patent application Ser. No. 12/480,994, filed Jun. 9, 2009, and published as U.S. Patent Publication No. 2010/0307936, which is incorporated herein by reference. In one example, box 124 is formed from a readily recyclable material to reduce the environmental impact of box manufacture. Box 124 defines a plurality of panels or walls separated from each other by one or more fold lines. More specifically, box 124 defines a first primary or front panel 140, a second primary or rear panel 142, an intermediate or top panel 144, and opposing side panels 146.

As illustrated in FIG. 12, rear panel 142 is positioned longitudinally opposite front panel 140, and top panel 144 extends between front panel 140 and rear panel 142. Top panel 144 has a width smaller, in one embodiment, just slightly smaller, than a width of an opening formed by hanger 10 between first sidebar 24 and second sidebar 26. In one embodiment, front panel 140 and rear panel 142 respectively define longitudinally extending free edges opposite top panel 144 collectively defining an open bottom of box 124. In one embodiment, front, rear, and top panels 140, 142, and 144 are of similar (e.g., identical) widths. In one example, front panel 140 is substantially similar in size and shape to rear panel 142.

Opposing side panels 146 each extends between and borders each of front panel 140 and rear panel 142. In one embodiment, side panels 146 are shorter than front panel 140 and rear panel 142, but are aligned with lower edges thereof such that a side opening 148 is formed above each opposing side panel 146 between the respective one of opposing side panels 146, front panel 140, rear panel 142, and top panel 144. Side openings 148 are similarly sized, and in one embodiment, are sized just slightly larger than a thickness of textile product 122 over fold line 126 and a height of lower crossbar 22. A box cavity is formed between front panel 140, rear panel 142, top panel 144, and opposing side panels 146.

In one embodiment, indicia, which is generally indicated by dashed box 152 in FIG. 12, are included on any exterior surface of box 124, for example, an exterior surface of one or more of front panel 140, rear panel 142, top panel 144, and opposing side panels 146. In one example, indicia 152 generally include promotional, identification, description, and/or other information regarding textile product 122 (e.g., dimensions of textile product 122, a picture of textile product 122 in use, a brand associated with textile product 122, and/or other depiction or text).

To assemble packaged product assembly 120, textile product 122 is folded into a desired configuration. More specifically, textile product 122 is folded into a width slightly smaller than a width of box 124 measured between front panel 140 and rear panel 142. Then, textile product 122 is folded into at least two portions (for example, first portion 128 and second portion 130) separated by fold line 126 and any other necessary fold lines. Depending on the length of textile product 122 and the folding configuration, the number of folded portions may vary.

Once folded, or while folding, a fold line, e.g., fold line 126, is placed directly over lower crossbar 22 of hanger 10. In one embodiment, to facilitate placement of fold line 126 over lower crossbar 22, second end 76 of lower crossbar 22 is rotated away from free end 78 of the second sidebar 26 of hanger 10 as generally illustrated in FIG. 10. Once textile product 122 is properly positioned on lower crossbar 22 (i.e., between first sidebar 24 and second end 76), box 124 is positioned relative to textile product 122 and hanger 10. More specifically, top panel 144 is positioned to extend directly over lower crossbar 22 and just below upper crossbar 20 of hanger 10 such that an interior surface of box 124 contacts and/or faces textile product 122, and textile product is at least partially maintained with the box cavity. Once positioned, second end 76 of lower crossbar 22 is coupled with free end 78 of second sidebar 26 to close hanger 10 via latch 28. In one example, second end 76 is coupled with free end 78 by raising second end 72 of lower crossbar 22 from the open hanger position shown, for example, in FIG. 10, to vertically align return tab 104 of lower crossbar 22 with notch 94 formed in second sidebar 26 and pushing second end 72 rearwardly toward notch 94, thereby, moving return tab 104 through notch 94 to a rear side of second sidebar 26. Subsequently, second end 72 of lower crossbar 22 is moved downwardly to set second end 72 of lower crossbar 22 to snugly fit at least partially within space 96 defined between flange 90 and protrusion 92 of second sidebar 26 to hold hanger 10 in a closed position as shown, for example, in FIG. 11. Other suitable latches or closures will be apparent to those of skill in the art upon reading this application, for example, the closure disclosed in U.S. patent application Ser. No. 12/480,994, filed Jun. 9, 2009, and published as U.S. Patent Publication No. 2010/0307936, which is incorporated herein by reference.

Box 124 is then wrapped around textile product 122, or, in one embodiment, is wrapped around textile product 122 before closing hanger 10. More specifically, in one example, box 124 is folded downwardly from top panel 144 about adjacent fold lines until front panel 140 and rear panel 142 extend downwardly from top panel 144 substantially parallel to one another. Each opposing side panel 144 is folded until it extends substantially perpendicularly with respect to rear panel 142 and is coupled to each of front panel 140 and rear panel 142. The resulting box 124 is maintained in a folded position around textile product 122. In one embodiment, textile product 122 is tightly maintained by box 124 and compressed within a cavity of box 124 between front panel 140 and rear panel 142 to decrease shifting of textile product 122 relative to box 124 during shipping, transport, etc. For example, in one embodiment, a depth of folded textile product 122 measured from a front to a back of folded textile product 122 is actually decreased when compressed between front panel 140 and rear panel 142. To further secure textile product 122, in one embodiment, any one or more of pins, plastic tag fasteners, staples, and other connectors may be used to secure adjacent portions 128, 130, and/or any other portions to one another to further prevent or at least decrease any undesired shifting of textile product 122. Other variations will be apparent to those of skill in the art.

When opposing side panels 146 are folded and secured, a side opening 148 is formed above each respective opposing side panel 146, below top panel 144, and between front panel 140 and rear panel 142. Side opening 148 is sized to allow lower crossbar 22 of hanger 10 to laterally extend beyond each opposing side panels 146, and, in one example, is substantially rectangular in shape. As such, in one example, a depth of side opening 148 is substantially equal to a depth of side panel 146 and/or a depth of top panel 144 (i.e., a distance between front panel 140 and rear panel 142). In one embodiment, a height of side opening 148 is substantially equal to a distance between top panel 144 and top free edge 80 and/or 84 and/or is substantially equal to a distance that each of front panel 140 and rear panel 142 extend above top free edge 80. By forming an entire side opening 148 rather than just a small hole in one or both of opposing side panels 146, box 124 is more versatile and allows for different positions of lower crossbar 22 relative to top panel 144, for instance, depending on the thickness of textile product 122 at fold line 126. In one embodiment, the depth of side opening 148 is equal to at least about 0.5 inches, and the height of side opening 148 is equal to at least about 0.5 inches. In one example, at least one of the depth and the height of side opening 148 is equal to at least about one inch.

In addition, by leaving side opening 148 entirely open to top panel 144 and supporting hanger 10 by hook 14, gravitational forces pull top panel 144 and textile product 122 downwardly toward lower crossbar 22 such that textile product 122 is, in one embodiment, pinched or similarly secured between lower crossbar 22 of hanger 10 and top panel 144 by compression. As such, a single sized box 124 can be used with a larger plurality of textile product sizes. However, one of skill in the art will recognize that the depth, length, and width of both hanger 10 and box 124 can easily be enlarged or shortened depending on the particular textile product 122 being displayed and/or the available space in a retail display.

The resultant packaged product assembly 120 provides an environmentally and economically superior packaging as compared to conventional polyvinyl bags. In addition, packaged product assembly 120 can relatively easily be reassembled if so desired by the end consumer, for example, should the consumer desire to return packaged product assembly 120 to the store after opening packaged product assembly 120. The clean and neat reassembly allows a returned packaged product assembly 120 to be placed in the retail display along with other original packaged product assemblies 120 in a uniform and aesthetically pleasing manner. The display of returned or otherwise repackaged products using conventional polyvinyl bags was discouraged since any such bags generally had been torn by a consumer attempting to access the corresponding article. The resulting torn bag generally could not be neatly repackaged in an inconspicuous and/or aesthetically pleasing manner without returning the article to the original manufacturer. Therefore, for aesthetic and other reasons, it was generally undesirable to hang torn packaging on a retail display. For at least this reason, the present invention according to embodiments described herein presents a marked improvement over such prior art packaging.

Figure 13:
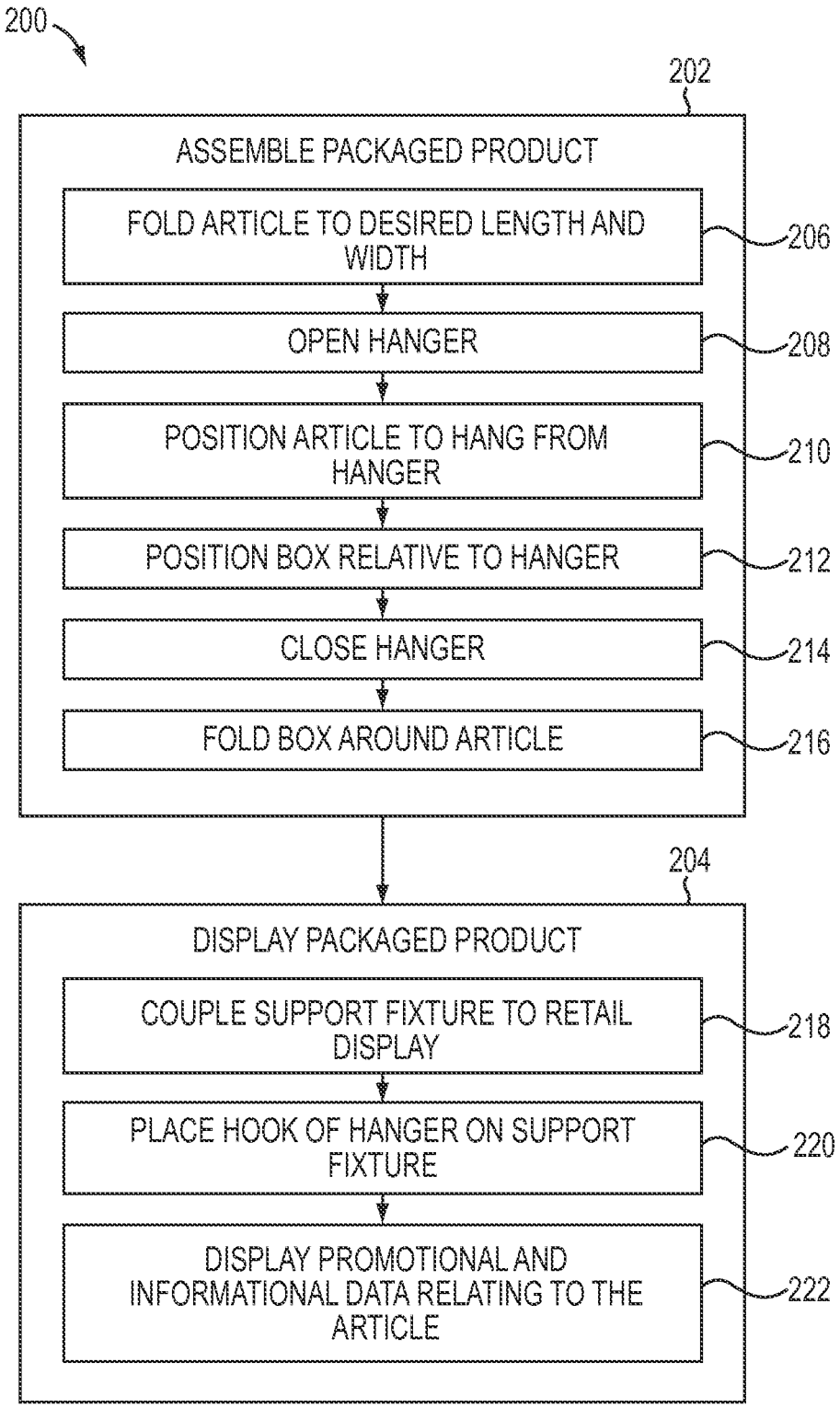
FIG. 13 is flow chart illustrating a method of providing and assembling a packaged product, according to one embodiment of the present invention.

FIG. 13 illustrates a method of assembling and displaying one or more packaged product assemblies 120 described with respect to FIGS. 1-12. At 202, packaged product assembly 120 is assembled. For example, at 206, textile product 122 is folded to a desired length and width. More specifically, as described above, textile product 122 is folded to a width slightly smaller than the width of front panel 140, rear panel 142, and/or top panel 144. Following folding textile product 122 into a desired width, textile product 122 is folded lengthwise into a desired length including forming at least two portions, e.g., first portion 128 and second portion 130, separated by fold line 126 and any other similar fold lines. In one example, the desired length is longer than front panel 140 and/or rear panel 142 such that an exposed portion 154 of textile product 122 will hang below box 124 allowing a potential consumer to both view and touch textile product 122 while viewing exterior surfaces of box 124.

At 208, hanger 10 is opened, that is second end 76 of lower crossbar 22 is unlatched from free end 78 of second sidebar 26, unless hanger 10 is already opened (e.g., had never been latched), in which instance, operation 208 may be eliminated. At 210, textile product 122 is placed over lower crossbar 22 of open hanger 10. More specifically, hanger 10 is opened by moving second end 76 of lower crossbar 22 away from free end 78 of second sidebar 26. Once hanger 10 is opened, lower crossbar 22 can easily be slid between first and second portions 128 and 130 of textile product 122, for example, just below fold line 126.

At 212, box 124 is positioned relative to hanger 10. In one example, top panel 140 of box 124 is positioned just above lower crossbar 22 of hanger 10 and fold line 126 of textile product 122. At 214, hanger 10 is closed. More specifically, in one embodiment, second end 76 of lower crossbar 22 is raised and pushed toward second sidebar 26 moving tab 104 through notch 94. Second end 76 moves back down nesting hanger 10 in space 96 between protrusion 92 and the portion of front surface 32 defined by second sidebar 26 to selectively secure hanger 10 in a closed position. In one embodiment, hanger 10 is closed at 214 before either one or both of operations 210 and 212 as will be apparent to those of skill in the art upon reading the present application.

At 216, box 124 is folded around textile product 122. For example, as described above, front panel 140 and rear panel 142 are folded down to interact with first portion 128 and second portion 130, respectively, of textile product 122. Opposing side panels 144 are positioned and secured to partially cover opposing sides of textile product 122. When assembled, lower crossbar 22 of hanger 10 extends through each side opening 148 of box 124 such that first and second sidebars 24 and 26 are positioned on opposite sides of textile product 122 and box 124. Further, top panel 144 of box 124 is positioned between textile product 122 and upper crossbar 20 of hanger 10.

At 204, a plurality of fully assembled packaged product assemblies 120 are positioned in a retail store as part of a retail product display, for example, as described in U.S. patent application Ser. No. 12/480,994, filed Jun. 9, 2009, and published as U.S. Patent Publication No. 2010/0307936, which is incorporated herein by reference, and as will otherwise be apparent to one of skill in the art after reading this application. At 220, each packaged product assembly 120 is hung from a support rod or other suitable structure via hook 14 of the corresponding hanger 10. In particular, in one embodiment, each of the plurality of packaged product assemblies 120 is hung from a single support rod. As such, a number of packaged product assemblies 120 can be hung in a relatively small area of a retail display without requiring any horizontal shelving for support.

At 222, promotional informational data relating to textile product 122 is displayed. For example, such data may be displayed as indicia 152 on box or other associated sign within the retail display as will be apparent to those of skill in the art upon reading this application. Once hung for display, textile product 122 is easily viewed and, if desired, tactilely observed (e.g., by touching of exposed portion 154 of textile product 122), by a potential consumer. The ready access to textile product 122 increases accuracy of consumer perception of textile product 122 as compared to prior packaging, where textile product 122 would have been completely enclosed in a polyvinyl bag, and, in many instances, increases the likelihood that a consumer will purchase textile product 122.

In one embodiment, displaying packaged product assemblies 120 at 204 includes displaying repackaged textile products 122. As described above, the formation of box 124 allows packaged product assembly 120 to be relatively easily disassembled and reassembled. The ease of disassembly and reassembly allows an textile product 122 to be purchased and removed from box 124 and hanger 10 by a consumer, and to still be repackaged with box 124 and hanger 10 in the event that the consumer decides to return textile product 122 to the retail store. Since, upon return, the reassembled packaged product assembly 120 appears substantially identical to original packaged product assemblies 120, any re-packaged product(s) 120 can easily be hung or displayed along side original packaged product assemblies 120 in a neat, uniform and aesthetically pleasing manner. In addition, since, in one embodiment, materials used to form at least box 124 and perhaps hanger 10 are readily recyclable, the packaging for textile product 122 is environmentally friendly especially as compared to the generally non-recyclable polyvinyl bags conventionally used to display similar articles.

Although the invention has been described with respect to particular embodiments, such embodiments are for illustrative purposes only and should not be considered to limit the invention. Various alternatives and modifications within the scope of the invention in its various embodiments will be apparent to those with ordinary skill in the art.

What is claimed is:

1. A hanger comprising:

a body including:

an upper crossbar, a lower crossbar spaced from and extending substantially parallel to the upper crossbar, a first sidebar extending between the upper crossbar and the lower crossbar, and a second sidebar extending between the upper crossbar and the lower crossbar opposite the first sidebar; and a hook coupled with and extending upwardly from a center of the upper crossbar;

wherein:

the upper crossbar includes a substantially linear intermediate section, an upper reinforcement section extending above the substantially linear intermediate section, a lower reinforcement section extending below the substantially linear intermediate section, a first rib extending between and bordering each of the substantially linear intermediate section and the upper reinforcement section, and a second rib extending between and bordering each of the substantially linear intermediate section and the lower reinforcement section, each of the first rib and the second rib have a thickness greater than each of the substantially linear intermediate section, the lower reinforcement section, and the upper reinforcement section, each of the upper reinforcement section and the lower reinforcement section define a substantially planar rear surface and an opposite substantially planar front surface, a length of the substantially linear intermediate section is substantially equal to an overall length of the hanger, and the lower reinforcement section and the upper reinforcement section each extend along at least about 60% of a total length of the substantially linear intermediate section.

2. The hanger of claim 1, wherein the first rib and the second rib are each substantially linear and extend substantially parallel to one another.

3. The hanger of claim 1, wherein the second rib is thicker than the first rib.

4. The hanger of claim 3, wherein the second rib is about twice as thick as the first rib.

5. A hanger comprising:

a body including:

an upper crossbar, a lower crossbar spaced from and extending substantially parallel to the upper crossbar, a first sidebar extending between the upper crossbar and the lower crossbar, and a second sidebar extending between the upper crossbar and the lower crossbar opposite the first sidebar;

wherein:

the upper cross bar includes a substantially linear intermediate section, an upper reinforcement section extending above the substantially linear intermediate section, a lower reinforcement section extending below the substantially linear intermediate section, a first rib extending between and bordering each of the substantially linear intermediate section and the upper reinforcement section, and a second rib extending between and bordering each of the substantially linear intermediate section and the lower reinforcement section, each of the first rib and the second rib have a thickness greater than each of the substantially linear intermediate section, the lower reinforcement section, and the upper reinforcement section, and each of the upper reinforcement section and the lower reinforcement section define a substantially planar rear surface and an opposite substantially planar front surface;

a third rib extending along a bottom edge of the lower reinforcement section opposite the second rib, wherein:

the second rib and the third rib are each at least about 25% thicker than the first rib, and the third rib extends a distance from the second rib that is greatest at a centerline of the hanger and tapers toward the second rib on both sides of the centerline; and a hook coupled with and extending upwardly from a center of the upper cross bar.

6. The hanger of claim 1, wherein:

the upper reinforcement section extends away from the substantially linear intermediate section with a height, and the height is at a maximum value near a centerline of the hanger and tapers away to a minimum value on either side of the centerline as the upper reinforcement section extends away from the centerline of the hanger.

7. The hanger of claim 1, wherein the substantially linear intermediate section includes opposing ends and a middle portion extending between the opposing ends, and the middle portion is thicker than the opposing ends.

8. The hanger of claim 1, wherein the upper crossbar is substantially solid as characterized by an absence of voids formed through the upper crossbar between an uppermost edge and lowermost edge of the upper crossbar.

9. The hanger of claim 1, wherein:

the first sidebar, the second sidebar, and the lower crossbar each have a similar thickness, and the substantially linear intermediate section of the upper crossbar has a thickness greater than the similar thickness of the first sidebar, the second sidebar, and the lower crossbar.

10. The hanger of claim 1, further comprising an outer perimeter rib extending around outside edges of each of the lower crossbar, the first sidebar, and the second sidebar, wherein:

the substantially linear intermediate section defines opposing ends, the first rib abuts the outer perimeter rib near each of the opposing ends of the substantially linear intermediate section, and the first rib and the outer perimeter rib have substantially identical thicknesses.

11. The hanger of claim 1, wherein the body is shaped in a substantially rectangular manner.

12. The hanger of claim 1, wherein the second side bar and the lower crossbar collectively define a latch for selectively coupling the second side bar and the lower cross bar to maintain the hanger in a closed position, and the hanger is in an open position when the second side bar and the lower crossbar are selectively uncoupled.

13. The hanger of claim 1, wherein the first rib and the second rib each extend behind the substantially planar rear surface and in front of the opposing substantially planar rear surface of each of the upper reinforcement section and the lower reinforcement section.

14. A hanger comprising:

a body including:

an upper crossbar, a lower crossbar spaced from and extending substantially parallel to the upper crossbar, a first sidebar extending between the upper crossbar and the lower crossbar, and a second sidebar extending between the upper crossbar and the lower crossbar opposite the first sidebar, wherein:

the upper cross bar includes a substantially linear intermediate section, an upper reinforcement section extending above the substantially linear intermediate section, a lower reinforcement section extending below the substantially linear intermediate section, a first rib extending between and bordering each of the substantially linear intermediate section and the upper reinforcement section, and a second rib extending between and bordering each of the substantially linear intermediate section and the lower reinforcement section, each of the first rib and the second rib have a thickness greater than each of the substantially linear intermediate section, the lower reinforcement section, and the upper reinforcement section, and each of the upper reinforcement section and the lower reinforcement section define a substantially planar rear surface and an opposite substantially planar front surface;

a third rib extending along a bottom edge of the lower reinforcement section opposite the second rib, wherein:

the second rib and the third rib are each at least about 25% thicker than the first rib, the third rib extends a distance from the second rib that is greatest at a centerline of the hanger and tapers toward the second rib on both sides of the centerline, the lower reinforcement section and the upper reinforcement section each extend along at least about 60% of a total length of the substantially linear intermediate section, the upper reinforcement section extends away from the substantially linear intermediate section with a height, the height is greatest near the centerline of the hanger and tapers toward the substantially linear intermediate section on both sides of the centerline as the upper reinforcement section extends away from the centerline of the hanger, and the upper crossbar is substantially solid characterized by an absence of voids formed through the upper crossbar between an uppermost edge and lowermost edge of the upper crossbar; and a hook coupled with and extending upwardly from a center of the upper cross bar.

15. The hanger of claim 1, in combination with a box including:

a front panel, a rear panel opposite and extending substantially parallel to the front panel, a top panel extending between and above the front panel and the rear panel, wherein the top panel is substantially planar and extends substantially perpendicular to each of the front panel and the rear panel, and a side panel extending from the front panel to the rear panel substantially perpendicular to the top panel to define a box cavity between the front panel, the rear panel, the top panel, and the side panel and a side opening above each side panel and below the top panel such that the front panel and the rear panel each extend partially above the side panel, the lower crossbar of the hanger extends through the box cavity and the side openings, and the upper crossbar of the hanger extends above the top panel of the box.

16. The combination of claim 15, further comprising: a product folded over the lower crossbar of the hanger and at least partially maintained within the box cavity.

17. A packaged product assembly comprising:

a hanger including a rectangularly shaped body having a centerline and a hook extending upwardly from the rectangularly shaped body, wherein:

the rectangularly shaped body includes a reinforced segment and an article support segment opposite the reinforced segment, the reinforced segment includes a middle portion, a first strengthening portion, and a second strengthening portion, the first strengthening portion extends in a first direction from the middle portion with a first strengthening portion height having a maximum value at the centerline and tapering toward the middle portion to a minimum value of the first strengthening portion height as the first strengthening portion extends away from and on both sides of the centerline, the second strengthening portion extends in a second direction, opposite the first direction, from the middle portion with a second strengthening portion height having a maximum value at the centerline and tapering toward the middle portion to a minimum value of the second strengthening portion height as the second strengthening portion extends away from and on both sides of the centerline, the rectangularly shaped body further includes opposing side segments, the article support segment extends substantially parallel to the reinforced segment, the hanger further includes:

a first rib, which extends between and borders each of the substantially linear middle portion and the first strengthening portion, a second rib, which extends between and borders each of the substantially linear middle portion and the second strengthening portion wherein each of the first rib and the second rib have a thickness greater than each of the substantially linear middle portion, the first strengthening portion, and the second strengthening portion, and each of the first strengthening portion and the second strengthening portion define a substantially planar rear surface and an opposite substantially planar front surface, and a third rib extending along an edge of the second strengthening portion opposite the second rib, wherein:

the second rib and the third rib are each at least about 25% thicker than the first rib, and the third rib extends a distance from the second rib that is greatest at the centerline of the hanger and tapers toward the second rib on both sides of the centerline; and an article folded over and hung from the article support segment of the rectangularly shaped body.

18. The packaged product assembly of claim 17, wherein:

the middle portion has a greater thickness than the opposing side segments, and the first rib, the second rib, and the third rib each have a greater thickness than each of the middle portion, the first strengthening portion, and the second strengthening portion.

19. The packaged product assembly of claim 17, wherein the reinforced segment of the rectangularly shaped body is substantially solid as characterized by an absence of voids formed through the reinforced segment between opposing edges of the reinforced segment.

20. A method of forming packaged product assembly for retail display, the method comprising:

providing an article folded for retail display;

suspending the article from the retail display using a hanger, the hanger including:

a reinforced segment, a lower segment spaced from and extending substantially parallel to the reinforced segment, opposing side segments each extending between the reinforced segment and the lower segment, and a hook coupled with and extending upwardly from a center of the reinforced segment;

wherein:

the reinforced segment includes a substantially linear intermediate section, an upper strengthening section extending above the substantially linear intermediate section, a lower strengthening section extending below the substantially linear intermediate section, a first elongated protrusion extending between and bordering each of the substantially linear intermediate section and the upper strengthening section, and a second elongated protrusion extending between and bordering each of the substantially linear intermediate section and the lower strengthening section, each of the first elongated protrusion and the second elongated protrusion have a thickness greater than each of the substantially linear intermediate section, the lower strengthening section, and the upper strengthening section, each of the upper strengthening section and the lower strengthening section define a substantially planar rear surface and an opposite substantially planar front surface, the lower strengthening section defines a lower strengthening section height having a maximum value at the center of the reinforced segment and a lowermost edge curving toward the substantially linear intermediate section as the lowermost edge extends away from and on both sides of the center of the reinforced segment toward the substantially linear intermediate section to a minimum value of the lower strengthening section height.

21. The method of claim 20, wherein suspending the article from the hanger includes providing the hanger such that:

the upper strengthening section defines an upper strengthening section height having a maximum value at the center of the reinforced segment and tapering toward the substantially linear intermediate section to a minimum value of the upper strengthening section height as the upper strengthening section extends away from and on both sides of the center of the reinforced segment.

22. The hanger of claim 1, wherein the upper reinforcement section extends along at least about 60% of an overall length of the hanger.

23. The method of claim 20, wherein:

the upper strengthening section substantially has a single thickness throughout an entirety of the upper strengthening section, and the upper strengthening section forms a topmost edge of the hanger other than the hook.

* * * * *